US010413772B2

(12) United States Patent
Zachariadis

(10) Patent No.: US 10,413,772 B2
(45) Date of Patent: Sep. 17, 2019

(54) WEIGHTED YOGA BLOCK WITH HANDLE

(71) Applicant: Nickolas G. Zachariadis, Milford, CT (US)

(72) Inventor: Nickolas G. Zachariadis, Milford, CT (US)

( * ) Notice: Subject to any disclaimer, the term of this patent is extended or adjusted under 35 U.S.C. 154(b) by 195 days.

(21) Appl. No.: 15/625,630

(22) Filed: Jun. 16, 2017

(65) Prior Publication Data

US 2018/0361191 A1 Dec. 20, 2018

(51) Int. Cl.
*A63B 21/06* (2006.01)
*A63B 21/00* (2006.01)
(Continued)

(52) U.S. Cl.
CPC ..... *A63B 21/0601* (2013.01); *A63B 21/0004* (2013.01); *A63B 21/00061* (2013.01);
(Continued)

(58) Field of Classification Search
CPC ..... A63B 21/0004; A63B 21/00061; A63B 21/06; A63B 21/0601; A63B 21/0602;
(Continued)

(56) References Cited

U.S. PATENT DOCUMENTS 5,102,124 A * 4/1992 Diodati ..... A63B 21/0605 482/106
5,518,486 A 5/1996 Sheeler
(Continued)

FOREIGN PATENT DOCUMENTS

CN 2620567 Y 6/2004

*Primary Examiner* — Joshua Lee
(74) *Attorney, Agent, or Firm* — QuickPatents, LLC; Kevin Prince

(57) ABSTRACT

A weighted yoga block with handle, the weighted yoga block with handle comprising: a base member; a first handle support member extending from the base member; a second handle support member extending from the base member; a handle connected to and rotatable with respect to the first and second handle support member; and the base member having an outer surface generally covered in a cushioned material. A carrying handle comprising: central handle; a first hook extending from the central handle, the first hook configured to hook under the handle of a first weighted yoga block with handle; a second hook extending from the central handle, the second hook configured to hook under the handle of a second weighted yoga block with handle. A weighted yoga block with handle system, the system comprising: a carrying handle, the carrying handle comprising: a first hook extending from the central handle, the first hook configured to hook under the handle of a first weighted yoga block with handle; a second hook extending from the central handle, the second hook configured to hook under the handle of a second weighted yoga block with handle; a first weighted yoga block with handle removeably attached to the first hook, the first weighted yoga block with handle comprising: a base member; a first handle support member extending from the base member; a second handle support member extending from the base member; a handle connected to and rotatable with respect to the first and second handle support member; and the base member having an outer surface generally covered in a cushioned material; a second weighted yoga block with handle removeably attached to the second hook, the second weighted yoga block with handle comprising: a base member; a first handle support member extending from the base member; a second handle support member extending from the base member; a handle connected to and rotatable with respect to the first and second handle support member; and the base member having an outer surface generally covered in a cushioned material.

11 Claims, 15 Drawing Sheets

(51) Int. Cl.

| | |
|---|---|
| ***A63B 21/075*** | (2006.01) |
| ***A63B 21/072*** | (2006.01) |
| *A63B 23/00* | (2006.01) |
| *A63B 23/04* | (2006.01) |

(52) U.S. Cl.
CPC ..... *A63B 21/0605* (2013.01); *A63B 21/072* (2013.01); *A63B 21/075* (2013.01); *A63B 21/4029* (2015.10); *A63B 21/4034* (2015.10); *A63B 21/4039* (2015.10); *A63B 21/4043* (2015.10); *A63B 21/4035* (2015.10); *A63B 23/0458* (2013.01); *A63B 2023/006* (2013.01)

(58) Field of Classification Search
CPC ..... A63B 21/0603; A63B 21/0604; A63B 21/0605; A63B 21/0606; A63B 21/0607; A63B 21/0608; A63B 21/0609; A63B 21/0615; A63B 21/0616; A63B 21/0617; A63B 21/0618; A63B 21/062; A63B 21/0622; A63B 21/0624; A63B 21/0626; A63B 21/0628; A63B 21/063; A63B 21/0632; A63B 21/065; A63B 21/068; A63B 21/072; A63B 21/075; A63B 21/4029; A63B 21/4034; A63B 21/4035; A63B 21/4039; A63B 21/4043; A63B 23/0458; A63B 23/1236; A63B 2023/006
See application file for complete search history.

(56) References Cited

U.S. PATENT DOCUMENTS

| | | | | |
|---|---|---|---|---|
| 7,156,791 | B2 * | 1/2007 | Edwards | A63B 21/0004 446/120 |
| 7,824,319 | B2 * | 11/2010 | Carlesimo | A63B 21/00047 446/85 |
| D639,876 | S * | 6/2011 | Tsou | D21/662 |
| 8,882,643 | B1 | 11/2014 | Calkins | |
| 9,067,104 | B1 * | 6/2015 | Kim | A63B 22/20 |
| 9,314,662 | B1 | 4/2016 | Willison | |
| 9,925,408 | B1 * | 3/2018 | Murdock | A63B 21/075 |
| 10,213,640 | B2 * | 2/2019 | St. Jeor | A63B 21/4035 |
| 2007/0087914 | A1 | 4/2007 | Connelly | |
| 2007/0219076 | A1 * | 9/2007 | Axelrod | A63B 21/00047 482/148 |
| 2009/0023563 | A1 * | 1/2009 | Liang | A63B 71/0036 482/106 |
| 2009/0062093 | A1 | 3/2009 | Clark | |
| 2010/0210431 | A1 * | 8/2010 | Hinton | A63B 21/00047 482/141 |
| 2010/0279833 | A1 * | 11/2010 | Gant | A63B 21/00047 482/141 |
| 2010/0317496 | A1 * | 12/2010 | Abranchess | A63B 21/0004 482/141 |
| 2012/0214653 | A1 * | 8/2012 | Tsou | A63B 21/00047 482/142 |
| 2013/0274078 | A1 | 10/2013 | Andrews | |
| 2013/0316884 | A1 * | 11/2013 | Gobeil | A63B 21/068 482/141 |
| 2013/0324382 | A1 * | 12/2013 | Wilson | A61H 7/007 482/142 |
| 2014/0274598 | A1 * | 9/2014 | Anderson | A63B 21/0728 482/108 |
| 2015/0126340 | A1 | 5/2015 | White | |
| 2015/0258363 | A1 | 9/2015 | Kampinski | |
| 2016/0030800 | A1 | 2/2016 | McClure | |
| 2017/0319895 | A1 * | 11/2017 | Davis | A63B 21/072 |
| 2018/0036588 | A1 * | 2/2018 | Brown | A63B 21/0004 |
| 2018/0169468 | A1 * | 6/2018 | Barrie, III | A63B 23/1236 |
| 2018/0185702 | A1 * | 7/2018 | Brown | A63B 21/0004 |

* cited by examiner

WEIGHTED YOGA BLOCK WITH HANDLE

TECHNICAL FIELD

The invention relates to the field of exercise, sports rehabilitation and training equipment, and more particularly to a weighted yoga block with handles.

BACKGROUND

Incorporating weights into yoga has been an increasingly popular trend; however adding weights to a yoga routine requires more equipment, and may be problematic when there is a limited amount of space. Also, many weights have rigid grips and hard surfaces that make transitioning between yoga poses difficult, and can cause discomfort when those weights lean against other body parts.

When weights are incorporated into yoga, weights tend to just be added equipment, and often there is little to no flow from posture to posture. Also, when transitioning from weighted postures to non-weighted postures the weights become a cumbersome obstacle that need to be moved or worked around. Weighted gloves can sometimes be used, however the disadvantage is that some yoga postures are not comfortable to do with weighted gloves and removing them is time consuming and disrupts the flow of the routine.

Therefore, there is a need for an apparatus that overcomes the above described and other disadvantages.

SUMMARY OF THE INVENTION

The disclosed invention relates to a weighted yoga block with handle, the weighted yoga block with handle comprising: a base member; a first handle support member extending from the base member; a second handle support member extending from the base member; a handle connected to and rotatable with respect to the first and second handle support member; and the base member having an outer surface generally covered in a cushioned material.

The invention also relates to a carrying handle comprising: central handle; a first hook extending from the central handle, the first hook configured to hook under the handle of a first weighted yoga block with handle; a second hook extending from the central handle, the second hook configured to hook under the handle of a second weighted yoga block with handle.

In addition, the invention relates to a weighted yoga block with handle system, the system comprising: a carrying handle, the carrying handle comprising: a first hook extending from the central handle, the first hook configured to hook under the handle of a first weighted yoga block with handle; a second hook extending from the central handle, the second hook configured to hook under the handle of a second weighted yoga block with handle; a first weighted yoga block with handle removeably attached to the first hook, the first weighted yoga block with handle comprising: a base member; a first handle support member extending from the base member; a second handle support member extending from the base member; a handle connected to and rotatable with respect to the first and second handle support member; and the base member having an outer surface generally covered in a cushioned material; a second weighted yoga block with handle removeably attached to the second hook, the second weighted yoga block with handle comprising: a base member; a first handle support member extending from the base member; a second handle support member extending from the base member; a handle connected to and rotatable with respect to the first and second handle support member; and the base member having an outer surface generally covered in a cushioned material.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
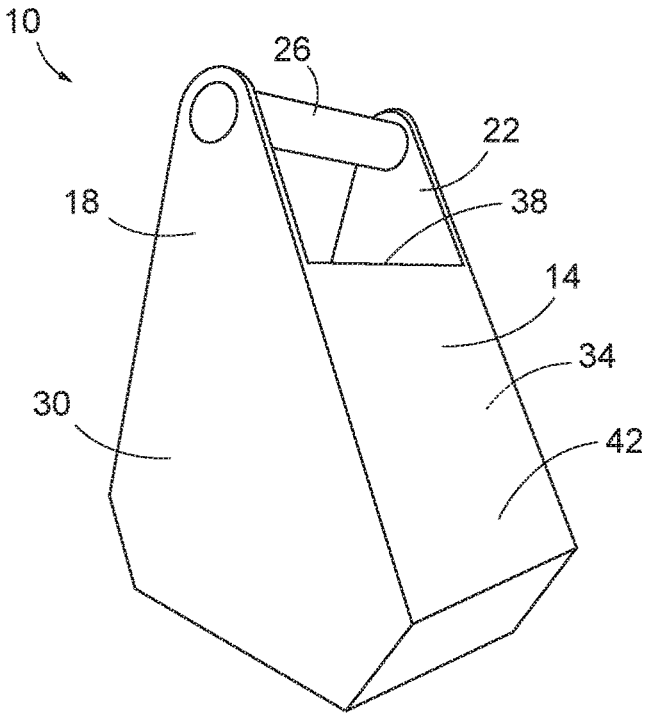
FIG. 1 is a perspective view of the disclosed weighted yoga block with handle.

FIG. 1 shows a front perspective view of a weighted yoga block with handle 10. The block comprises a base member 14, a first handle support member 18 extending from the base member, a second handle support member 22 extending from the base member, and a handle 26 rotatably attached to the first and second handle support members 18, 22. The base member 14 has a front side 30, rear side 34, and top side 38. The weighted yoga block with handle 10 may range in weight from about 2 pounds to about 10 pounds. The weighted yoga block with handle 10 will be generally soft to the touch. This may be achieved by generally encasing the weighted yoga block with handle 10 in a soft foam material, soft rubber, soft vinyl, cork, other traditional yoga block material, or other cushioning. The handle may also be cushioned, or may be uncushioned. The handle may also have a locking mechanism to keep the handle fixed when desired.

Figure 2:
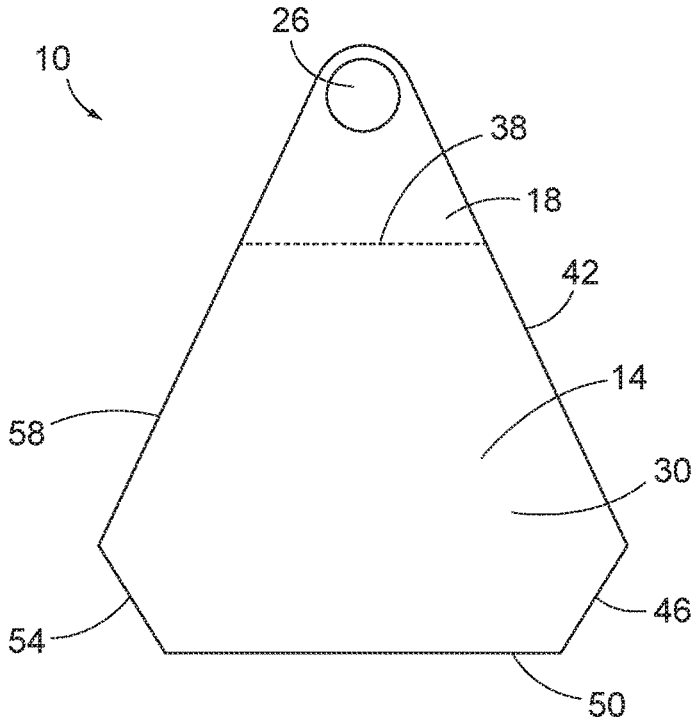
FIG. 2 is a front view of the weighted yoga block with handle from FIG. 1.

FIG. 2 shows a front view of the weighted yoga block with handle 10. In this view, one clearly see that the base member comprises a first angled side 42, a second angled side 46, a bottom side 50, a third angled side 54, and a fourth angled side 58. One can see that this embodiment of the weighted yoga block with handle 10 has a generally wedge shape. This wedge shape allows for the weighted yoga block 10 with handle to be positioned on the floor to give different heights to the highest surface of the block 10. The weighted yoga block with handle 10, may have all the abutting surfaces smoothed out, so there are no sharp edges. In another embodiment, the base member may comprise a removable compartment configured to hold interchangeable weights in ranges of between about 2 pounds and 10 pounds.

Figure 3:
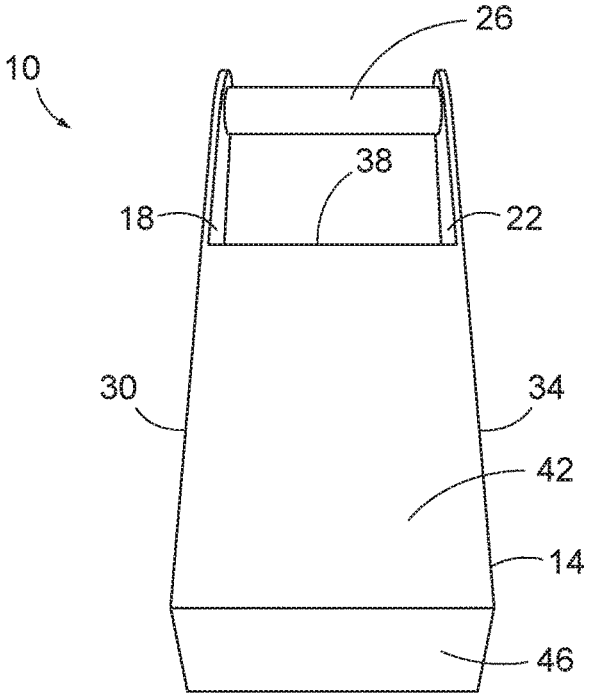
FIG. 3 is a side view of the weighted yoga block with handle from FIG. 1.

FIG. 3 shows a side view of the weighted yoga block with handle 10.

Figure 4:
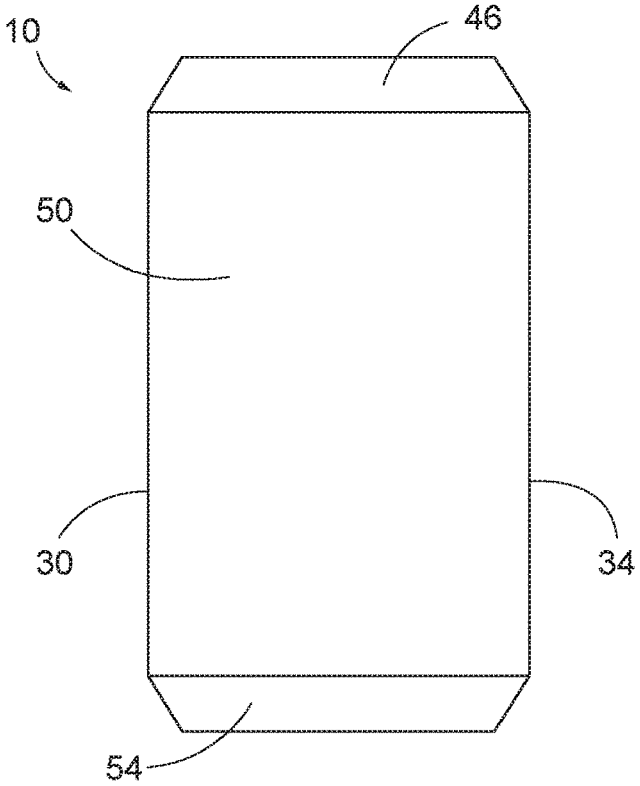
FIG. 4 is a bottom view of the weighted yoga block with handle from FIG. 1

FIG. 4 shows a bottom view of the weighted yoga block with handle 10.

Figure 5:
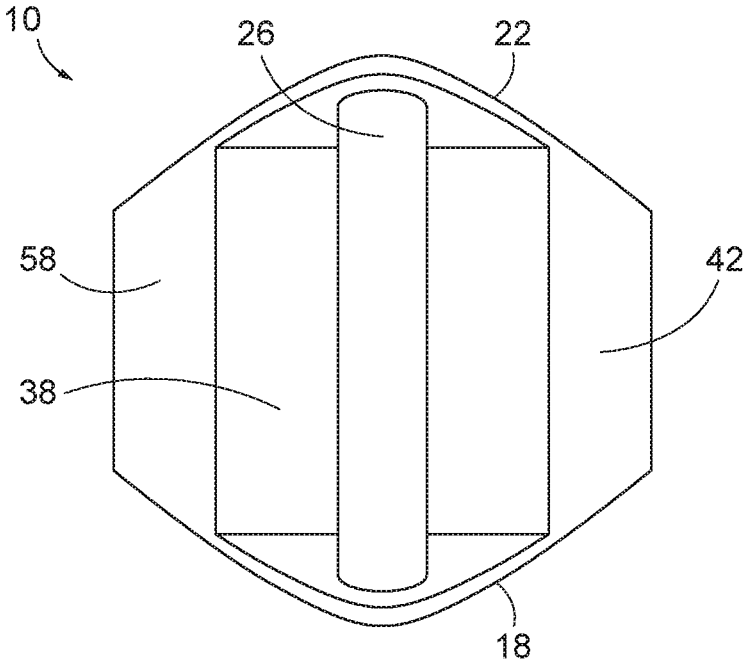
FIG. 5 is a top view of the weighted yoga block with handle from FIG. 1.

FIG. 5 shows a top view of the weighted yoga block with handle 10.

Figure 6:
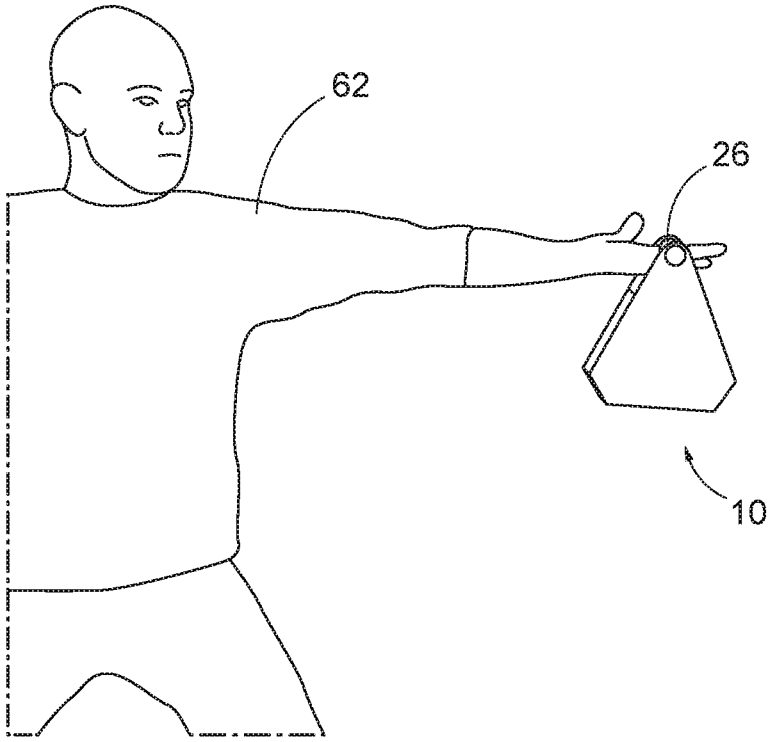
FIG. 6 is a view showing a user in a first yoga pose with the weighted yoga block with handle.

FIG. 6 shows a user 62 striking a yoga pose while holding the weighted yoga block with handle 10 by the handle 26. Please note the underhand grip.

Figure 7:
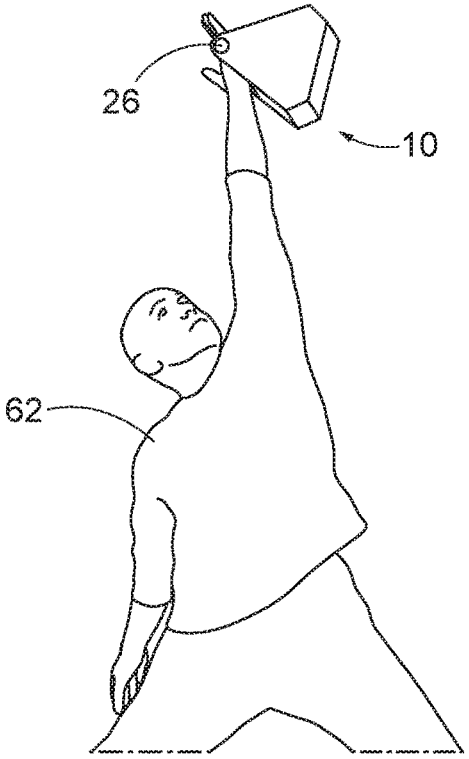
FIG. 7 is a view showing the user in a second yoga pose with the weighted yoga block with handle.

FIG. 7 shows the user 62 striking another yoga pose while holding the weighted yoga block with handle 10 by the handle 26.

Figure 8:
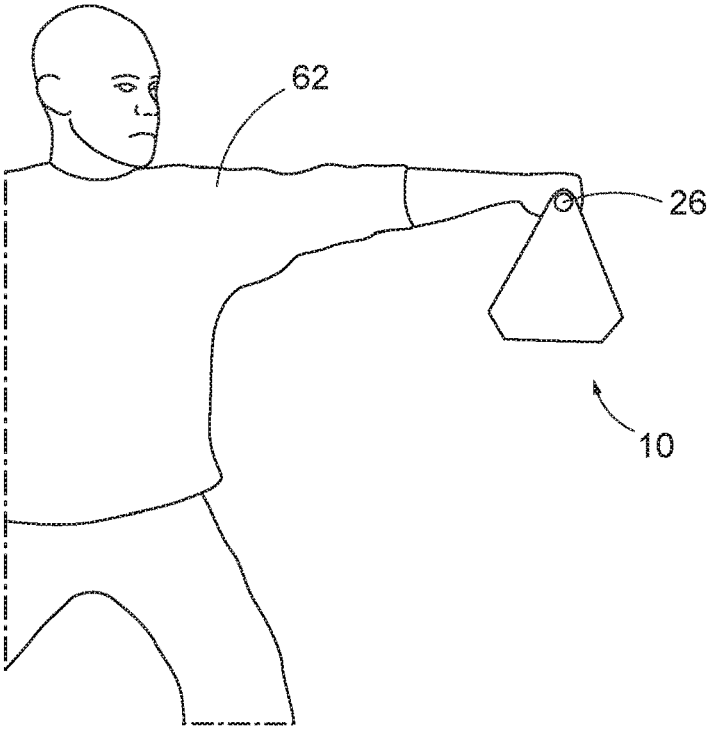
FIG. 8 is a view showing the user in a third yoga pose with the weighted yoga block with handle.

FIG. 8 shows a user 62 striking another yoga pose while holding the weighted yoga block with handle 10 by the handle 26. Please note the overhand grip.

Figure 9:
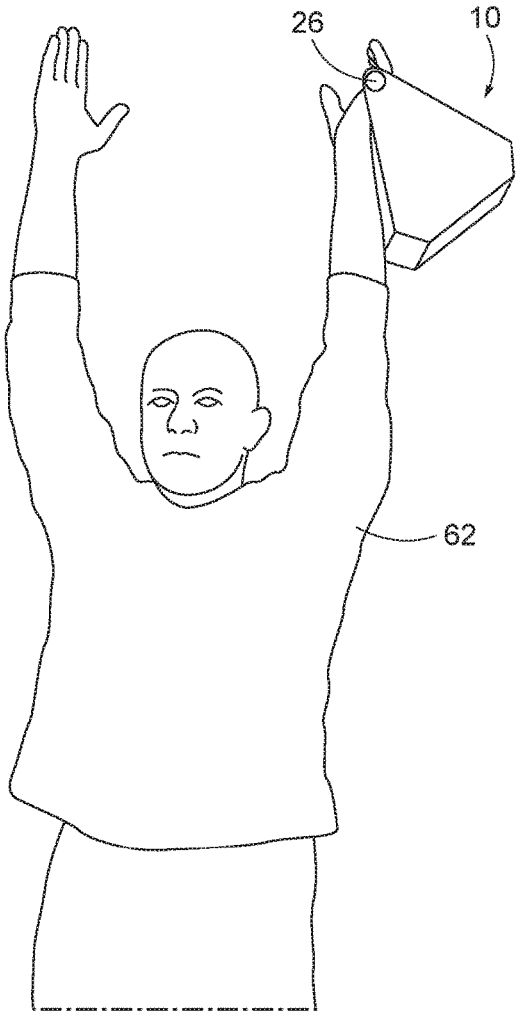
FIG. 9 is a view showing the user in a fourth yoga pose with the weighted yoga block with handle.

FIG. 9 shows a user 62 striking another yoga pose while holding the weighted yoga block with handle 10 by the handle 26. Please note the underhand grip.

Figure 10:
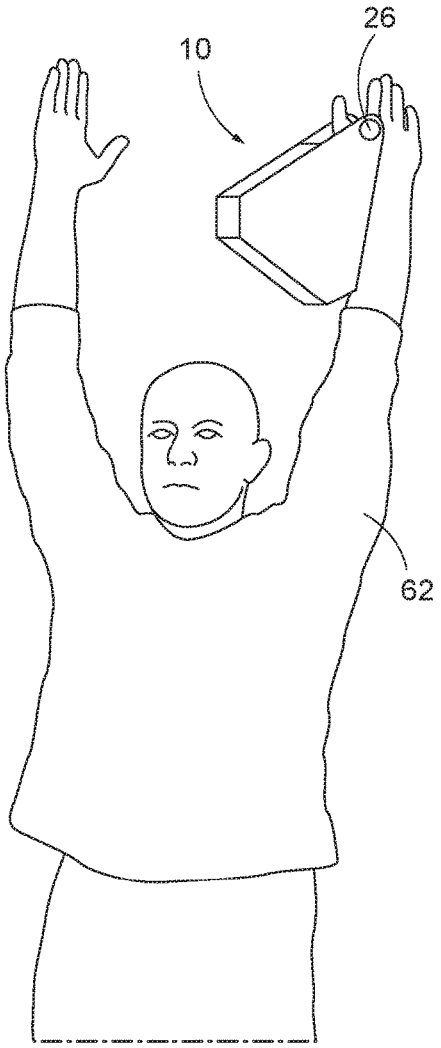
FIG. 10 is a view showing the user in a fifth yoga pose with the weighted yoga block with handle.

FIG. 10 shows a user 62 striking another yoga pose while holding the weighted yoga block with handle 10 by the handle 26. Please note the grip with the thumb. Note that the user can easily flow from one pose to the next because the handle 26 rotates. This allows the user to change poses without having to stop to re-grip the handle 26.

Figure 11:
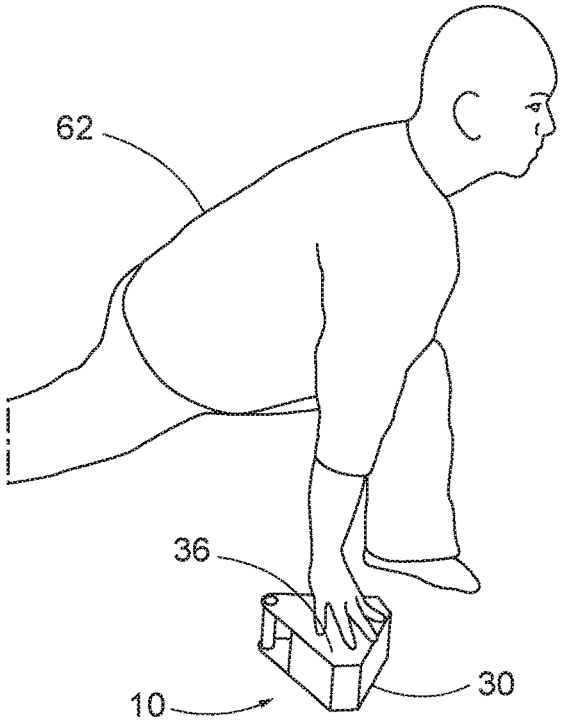
FIG. 11 is a view showing the user using the weighted yoga block with handle, as a yoga pose supporting device.

FIG. 11 shows a user 62 using the weighted yoga block with handle 10 as a yoga block, that is to provide support to the user 62 as he performs his yoga poses and exercises. In this scenario, the weighted yoga block with handle 10 is laying on its front side 30, with the rear side 34 facing upwards. The user's hands are on the rear side 34.

Figure 12:
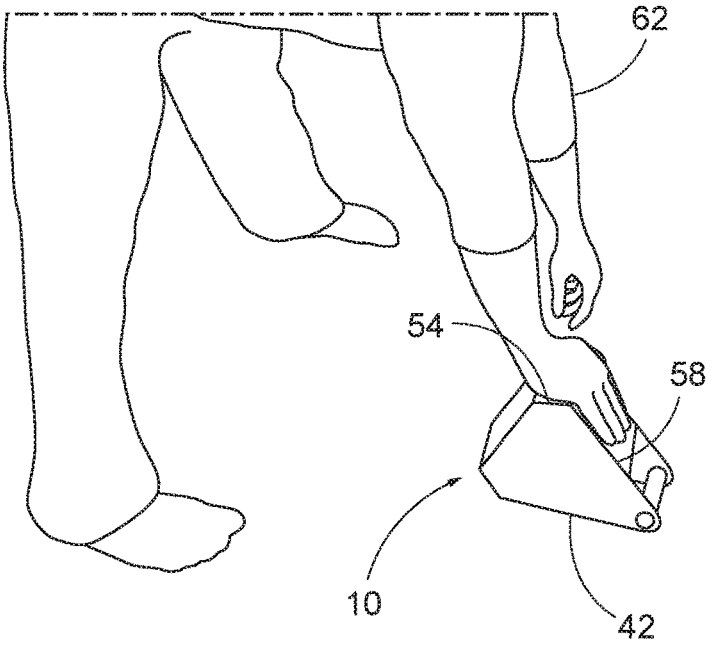
FIG. 12 is a view showing the user using the weighted yoga block with handle, as a yoga pose supporting device but in a different orientation.

FIG. 12 shows another scenario, where the weighted yoga block with handle 10 is laying on its first angled side 42, and the user's hands are on the third angled side 54 and fourth angled side 58. Due to the shape of the weighted yoga block with handle 10, in this position, the weighted yoga block with handle 10, the third angled side 54 and fourth angled side 58 are higher off the ground than the rear side 34 as used in FIG. 11. Thus, the user can lay or set the weighted yoga block with handle 10 on the floor or ground in a variety of positions, and the weighted yoga block with handle 10 will provide different surfaces at different heights from the floor and angles to the ground, depending on the needs and wants of the user 62 during his yoga routine.

Figure 13:
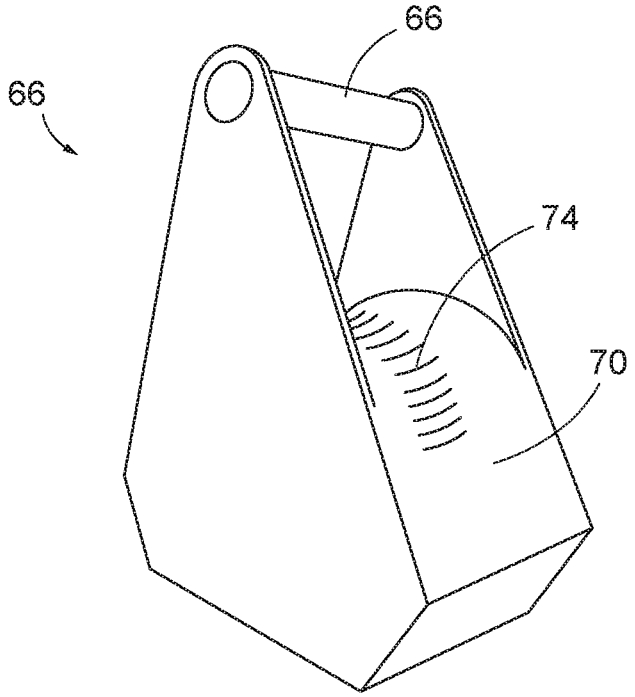
FIG. 13 is a perspective view of an arm cushioning embodiment of the weighted yoga block with handle.

FIG. 13 is perspective view of another embodiment of the weighted yoga block with handle 66. In this embodiment, the first angled side 42, the top side 38, the fourth angled side 58 have been replaced with a smooth contoured surface 70 configured to fit a user's arm when he grabs the handle 26 and his arm is abutting the contoured surface 70. The contoured surface 70 may have a grooved surface 74 configured to fit the average users forearm.

Figure 14:
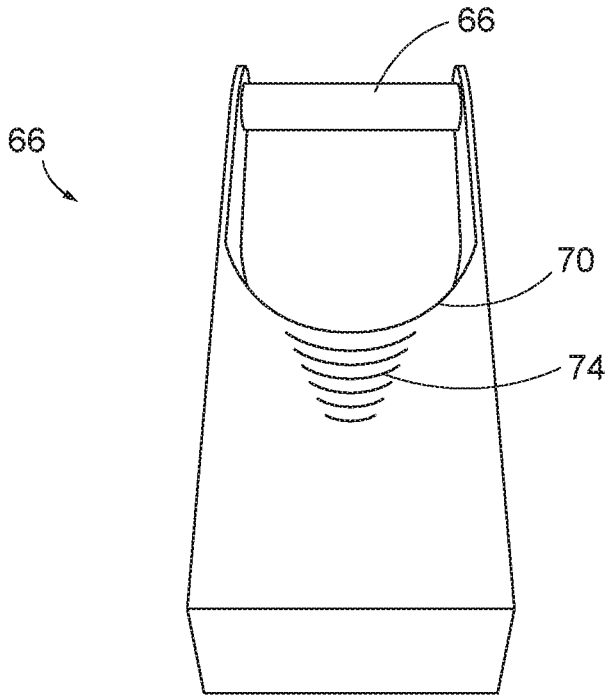
FIG. 14 is a side view of the weighted yoga block with handle from FIG. 13.

FIG. 14 is a side view of the weighted yoga block with handle 66 from FIG. 13.

Figure 15:
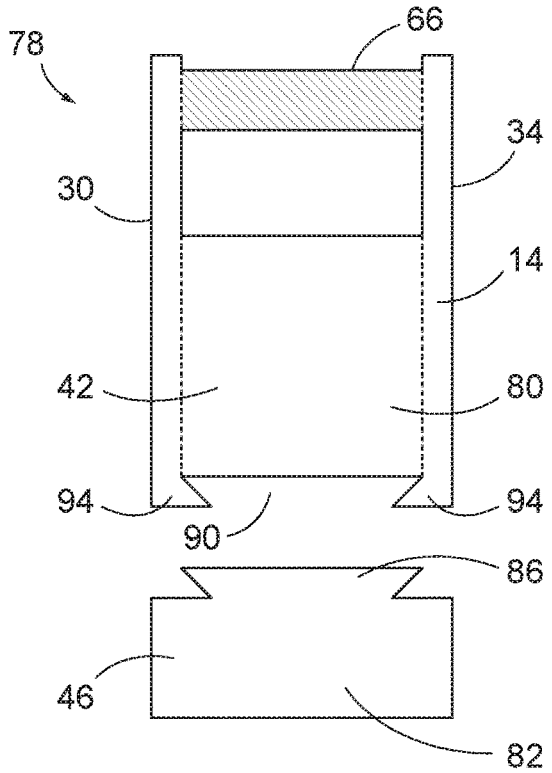
FIG. 15 is a side view of the weighted yoga block with handle in a dove tail embodiment.

FIG. 15 shows a side view of dove tail embodiment of the weighted yoga block with handle 78. In this embodiment, the base 14 comprises an upper portion 80 and a lower portion 82. The upper portion 80 removably attaches to the lower portion 82 via a dove tail. The dove tail comprises a tail 86, socket 90, and pins 94. In this embodiment, the weighted yoga block with handle 78 may come with several lower portions 82, where each of the lower portions may be of different weights, for instance one lower portion may be 2 pounds, another lower portion may be 4 pounds, another lower portion may be 6 pounds, etc. The dove tail design is just one embodiment of a removably attachable lower portion, any other suitable removeably attachable means may be used, including but not limited to snaps, buttons, zippers, hooks, Velcro, threaded members, etc.

Figure 16:
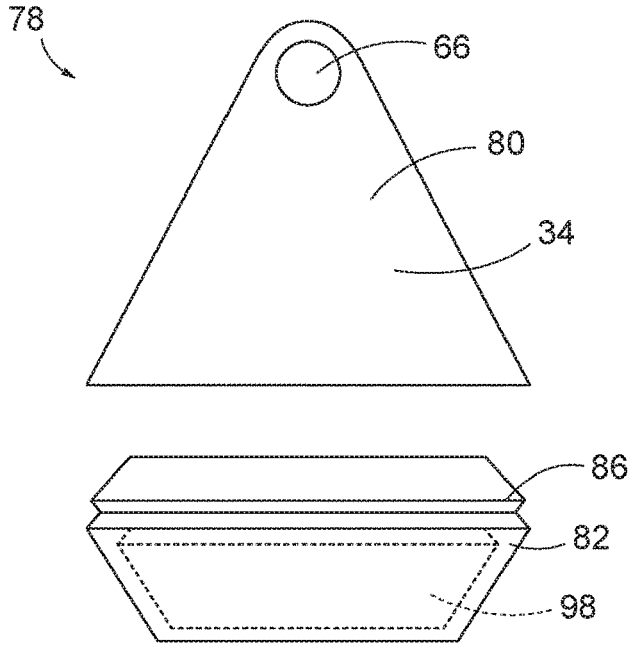
FIG. 16 is a perspective view of the weighted yoga block with handle from FIG. 15.

FIG. 16 is a front perspective view of the weighted yoga block with handle 78 from FIG. 15. The dotted volume represents a weight 98 in the lower portion 82.

Figure 17:
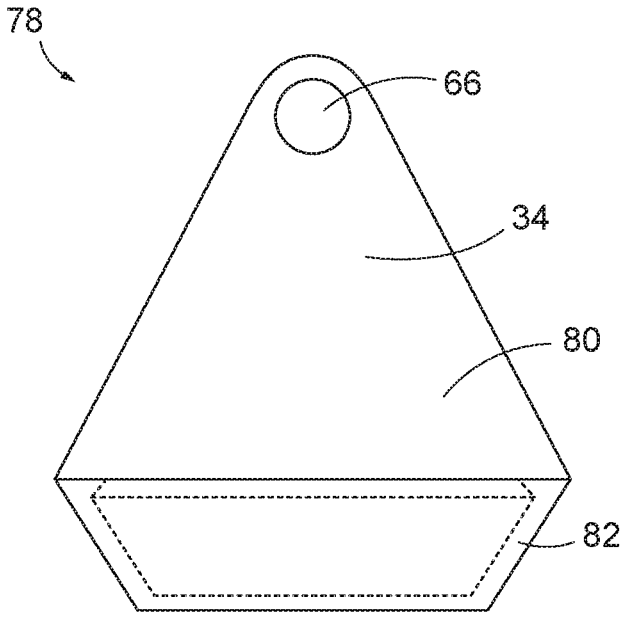
FIG. 17 is a perspective view of the weighted yoga block with handle from FIG. 15, but with the lower portion attached to the upper portion.

FIG. 17 is a front perspective view of the weighted yoga block with handle 78 with the lower portion 82 attached to the upper portion 80.

Figure 18:
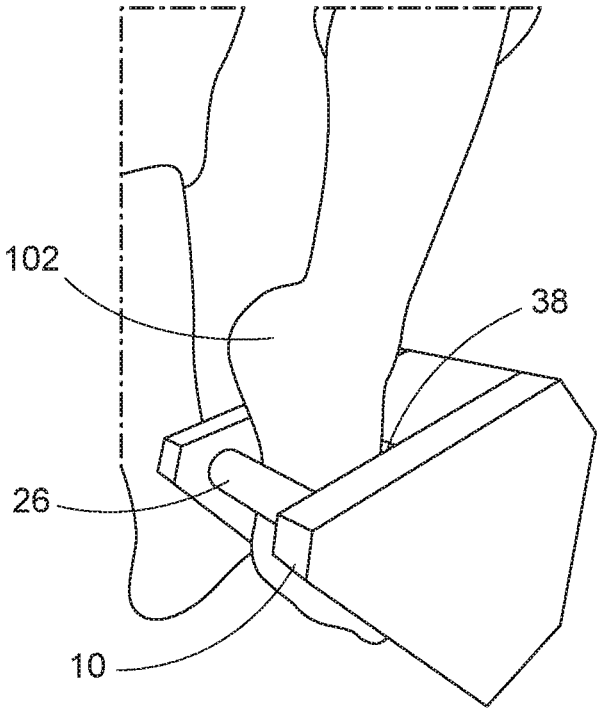
FIG. 18 is a view of showing user's foot located in the gap between the handle and the top side of the weighted yoga block with handle.

The weighted yoga block with handle 10 may be used in a variety ways, limited only by the creativity of the user. Along with being held at the handle 26 by the hands, the user can also manipulate the block around the body using their foot. By placing the foot through the handle and lifting the toes, the user can have complete control of the block with only one foot. This allows the user to add weighted holds to the lower extremities as well. FIG. 18 shows a user's foot 102 located in the gap between the handle 26 and the top side 38 of the weighted yoga block with handle 10. In this way, the user can move the yoga block 10 with his or her foot.

Figure 19:
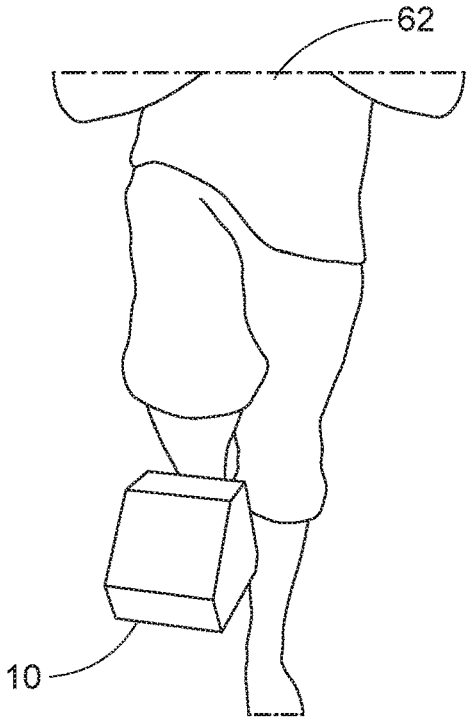
FIG. 19 shows the user holding the block with his foot, in a pose.

FIG. 19 shows the user 62 holding the block 10 with his foot in a pose.

Figure 20:
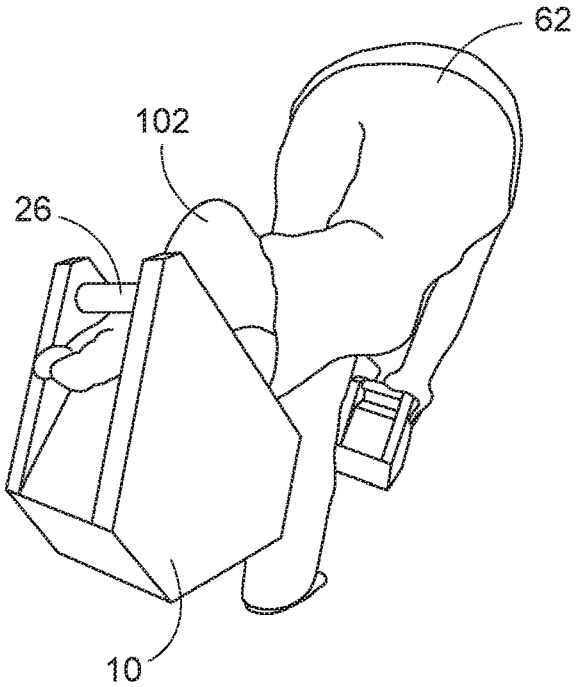
FIG. 20 shows the user in a bent over pose raising the block with his foot.

FIG. 20 shows the user 62 in a bent over pose raising the block 10 with his foot 102.

Figure 21:
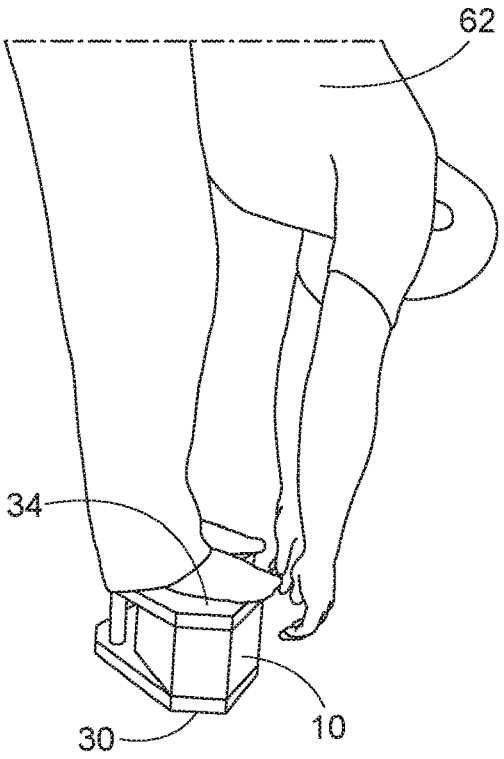
FIG. 21 shows the block laying on its front side, and the rear side is being stood upon by the user.

FIG. 21 shows the block 10 laying on its front side 30, and the rear side 34 is being stood upon by the user 62, in order to get a deeper stretch since his hands extend below the rear side 34 surface.

Figure 22:
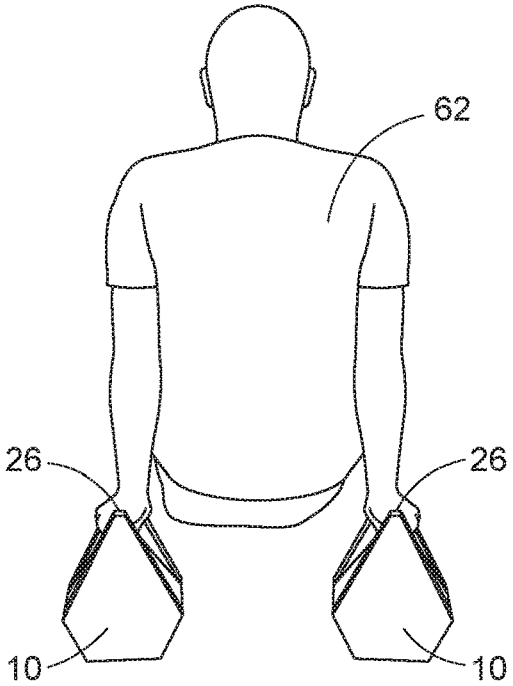
FIG. 22 shows the user using two blocks in order to do dips.

FIG. 22 shows the user 62 using two blocks 10, and is holding the blocks 10 by the handles 26 in order to do dips.

Figure 23:
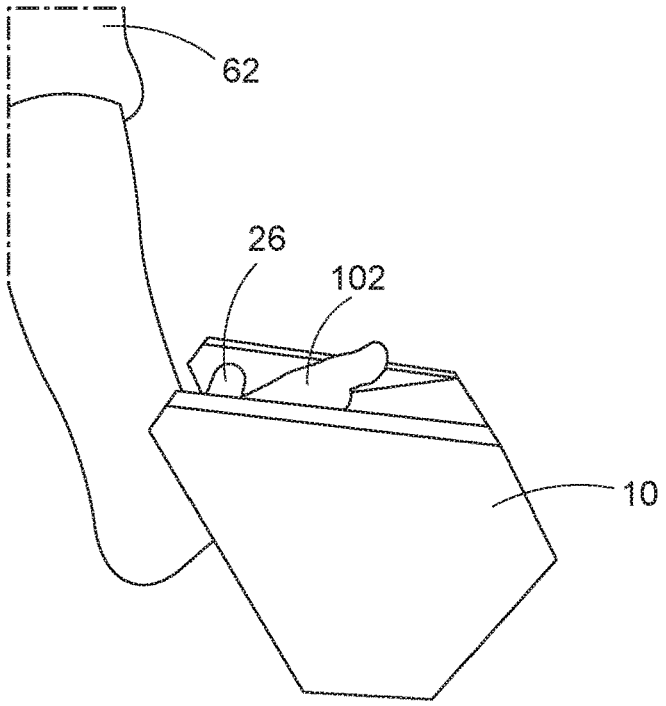
FIG. 23 shows the user with his foot inserted under the handle with the block angled on the floor in order to get a stretch in his foot and ankle.

FIG. 23 shows the user 62 with his foot 102 inserted under the handle 26 with the block 10 angled on the floor as shown, in order to get a stretch in his foot 102 and ankle.

Figure 24:
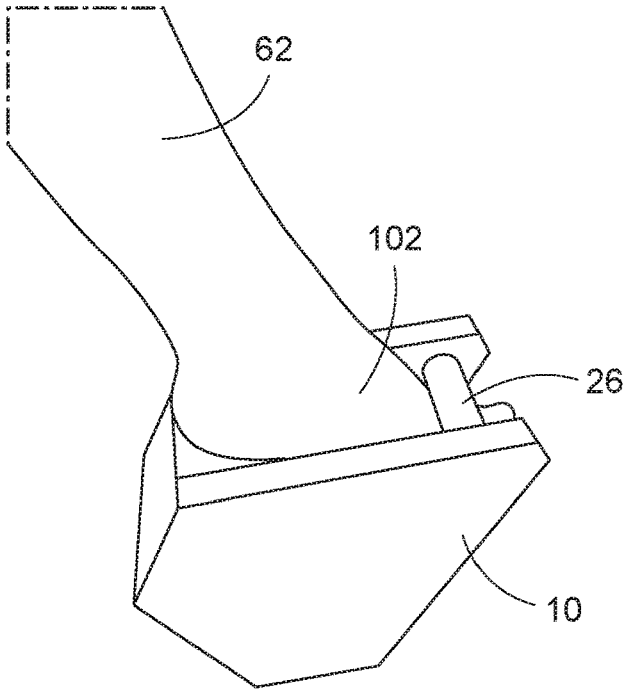
FIG. 24 shows the user with his foot inserted under the handle with the block angled on the floor in order to get a stretch in the front part of his foot and ankle.

FIG. 24 shows the user 62 with his foot 102 inserted under the handle 26 with the block 10 angled on the floor as shown, in order to get a stretch in the front part of his foot 102 and ankle.

Figure 25:
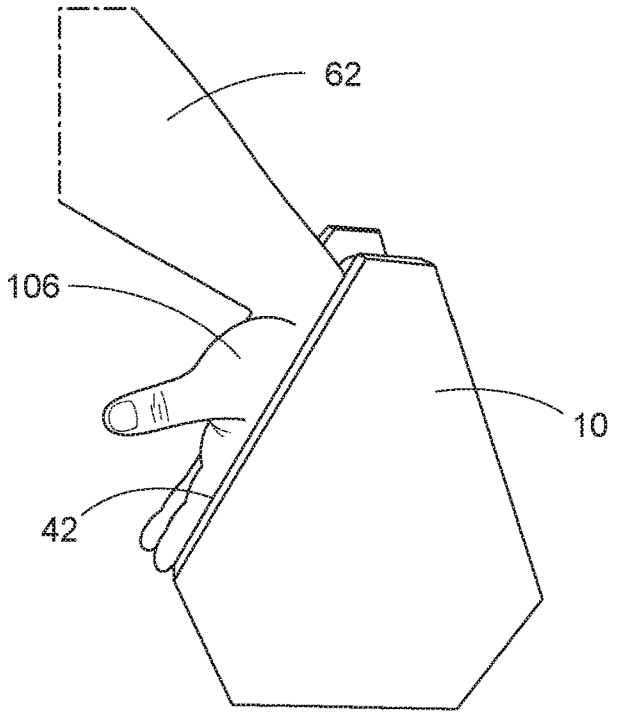
FIG. 25 shows the user with the back of his hand pressed against the first angled side of the block in order to get a stretch in his hand, wrist, and arm.

FIG. 25 shows the user 62 with the back of his hand 106 pressed against the first angled side 42 of the block 10 in order to get a stretch in his hand, wrist, and arm.

Figure 26:
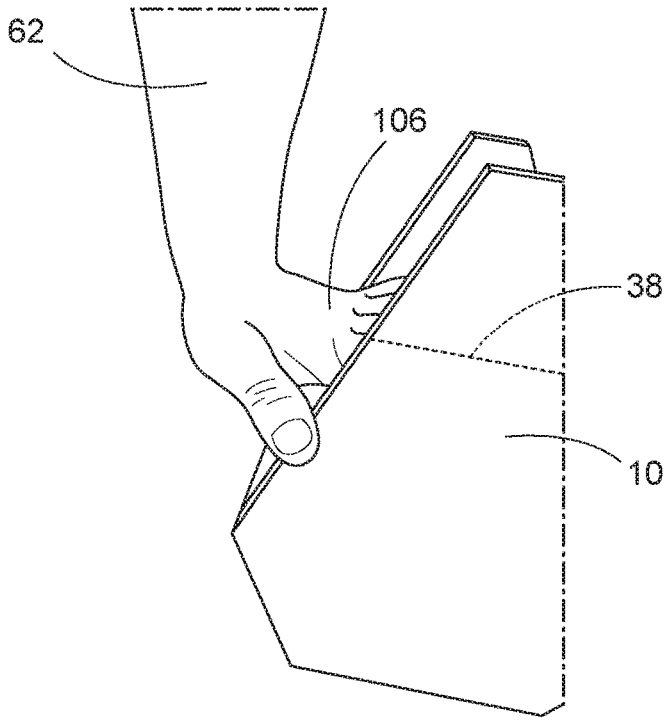
FIG. 26 shows the user with the palm of his hand pressed against the top side of the block in order to get a stretch in his hand, wrist, and arm.

FIG. 26 shows the user 62 with the palm of his hand 106 pressed against the top side 38 of the block 10 in order to get a stretch in his hand, wrist, and arm.

Figure 27:
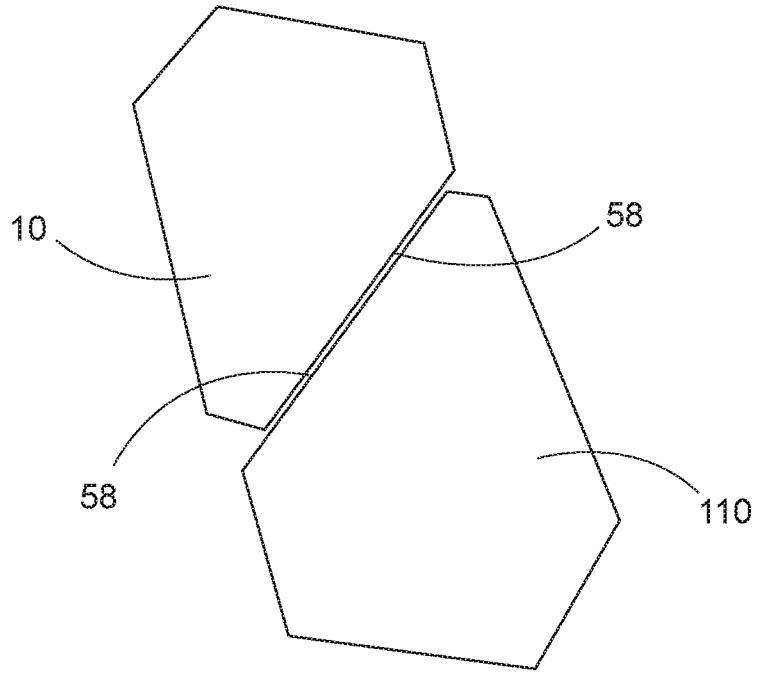
FIG. 27 shows a first weighted yoga block with handle and a second weighted yoga block with handle arranged in a first configuration.

FIG. 27 shows a first weighted yoga block with handle 10 and a second weighted yoga block with handle 110. The fourth angled side 58 of the first weighted yoga block with handle 10 is adjacent and/or abutting the fourth angled side 58 of the second block 110. In this configuration, the blocks 10, 110 form a platform or seat, for the user to use during other poses and rest.

Figure 28:
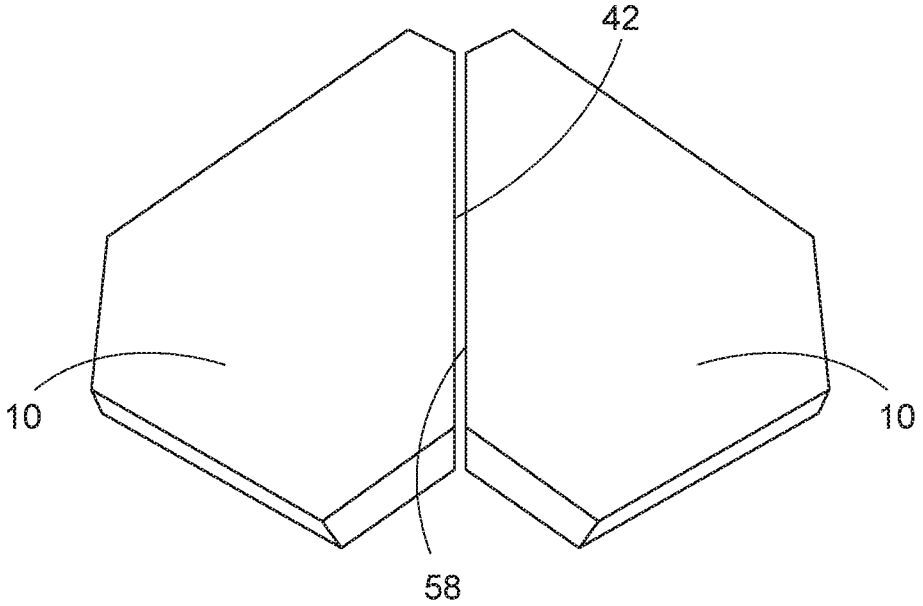
FIG. 28 shows another configuration of the first weighted yoga block with handle and the second weighted yoga block with handle.

FIG. 28 shows another configuration of the first weighted yoga block with handle 10 and a second weighted yoga block with handle 110. The first angled side 42 of the first weighted yoga block with handle 10 is adjacent and/or abutting the fourth angled side 58 of the second block 110. In this configuration, the blocks 10, 110 form a differently shaped platform or seat, for the user to use during other poses and rest.

Figure 29:
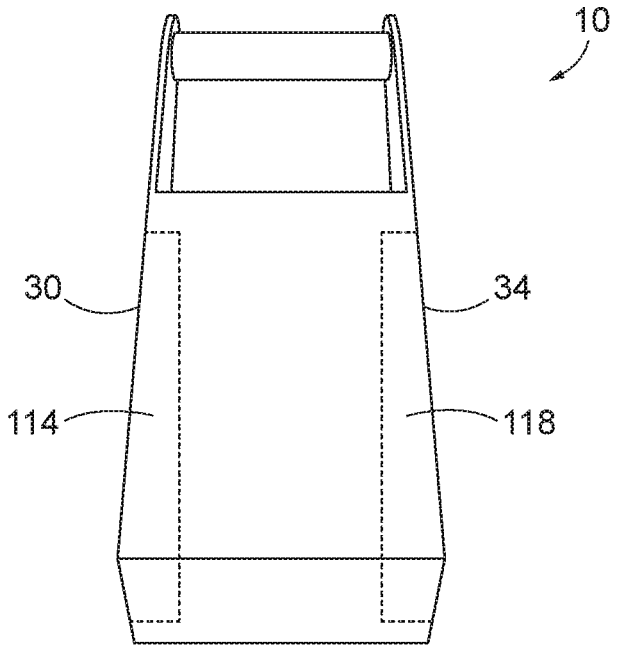
FIG. 29 shows another embodiment of the weighted yoga block with handle with weights on or near the front and rear side of the block.

FIG. 29 shows another embodiment of the weighted yoga block with handle 10. IN this embodiment, there may be permanent or removable weights 114, 118 attached or located on or adjacent to the front side 30 and rear side 34 of the block 10. In one embodiment the weights 114, 118 may be permanently attached to the block 10. In other embodiment, the weights 114, 118 may be replaceable, with different weights that weigh more or less than the originally installed weights.

Figure 30:
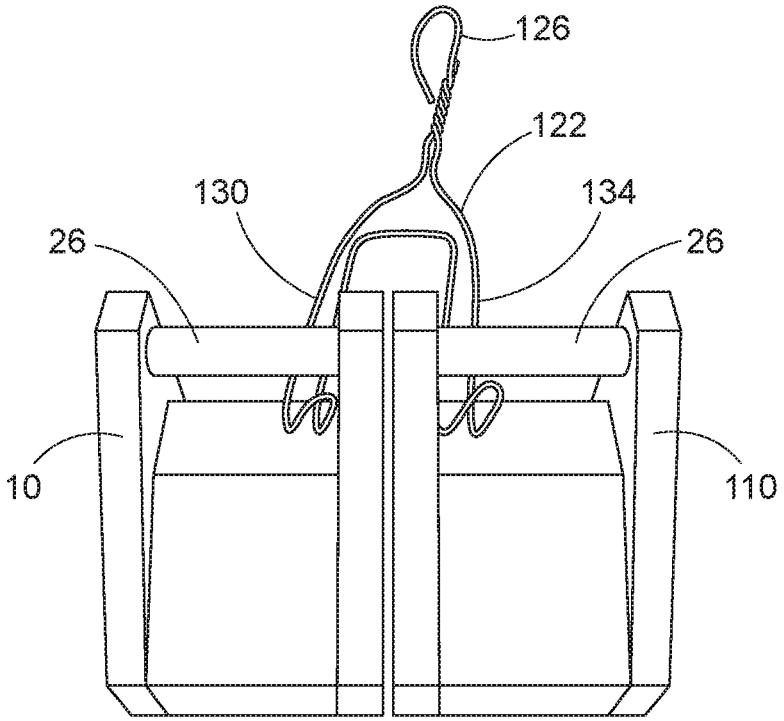
FIG. 30 shows a front view of a carrying handle.

FIG. 30 shows a system that includes a carrying handle 122 configured to carry at one or more weighted yoga blocks with handle. In this embodiment, the carrying handle is configured to carry a first weighted yoga block with handle 10 and a second weighted yoga block with handle 110. The carrying handle 122 comprises a central handle 126. Extending from the central handle 126 is a first hook 130 configured to hook under the handle 26 of a weighted yoga block with handle 10. Also extending from the central handle 126 is a second hook 134 configured to hook under the handle 26 of a second weighted yoga block with handle 110. Thus, with this system, a person can easily carry one or two weighted yoga blocks with handle. One of ordinary skill in the art will recognize that the carrying handle 122 can be configured with additional hooks to carry additional weighted yoga blocks with handle.

The weighted yoga block with handle is intended to bring the use of weights into yoga without increasing the amount of equipment and space needed to practice. The weighted yoga block with handle takes a traditional yoga block, and by adapting the shape and adding a rotating handle at the top and internal weights towards the base, creates a piece of equipment that not only can be used much in the same way as traditional yoga blocks, but can also be easily picked up and used as a piece of lifting equipment; transitioning smoothly between weight and yoga block depending on the needs of the pose. The multiple sides and heights make it possible to adjust the height of the block simply by changing the position of the weighted yoga block with handle depending on the needs of the individual, while the rotating handle allows the individual to move from one pose to the next without having to re-grip. The soft body of the block or contoured sides also keeps away any discomfort that may occur from unintended contact with other parts of the body during movements and holds.

The weighted yoga block with handle is unlike the shape of any other known yoga block. The rotating handle differs from the fixed grips of most weights, allowing for easy position transitioning without the need to re-grip. The weighted yoga block with handle also differs greatly from most weights in that, excluding the handle and internal weighted material, the majority of the outer surface of the weighted yoga block with handle is composed of softer cushioned material as opposed to just a protective plastic coating around a solid piece of metal.

The weighted yoga block with handle may consist of a cushioned foam or other yoga-block type material shaped into various wedge shapes, including but not limited to the ones shown in the figures. In the base member of the weighted yoga block with handle, there may be internal weights. Each weighted yoga block with handle may weigh in a range of about 2 pounds to about 10 pounds. The weighted yoga block with handle may come in incrementally increasing weights of 1 to 2 pounds.

Generally, all the sides of the weighted yoga block with handle will be generally smooth and flush. The weighted yoga block with handle will be able to be laid on at least 4 sides, plus upright, in order to allow stabilization at varying heights. The weighted yoga block with handle may be orientated such that the height of the highest surface of the block may range from about 4 inches to about 9 inches, or more. When used as a weight the weighted yoga block with handle may be grasped by its rotating handle and maneuvered around the body or held in isometric contraction.

The disclosed invention has many advantages. The handle rotates, allowing a user to flow from one pose to the next without having to re-grip the handle. The weighted yoga block with handle can be used as a yoga blog, and has a unique shape that allows one to orientate the block in different ways to have different height surfaces available to support the user. The weighted yoga block may have a surface configured to generally fit the arm of a user, to provide comfort to the user when using the block. The weighted yoga block with handle may come in different weights and/or the weight of the weighted yoga block with handle may be changed by using a changeable lower portion or weight inserts. The rotating handle may have a locking mechanism in the event the handle itself is being used for stability.

It should be noted that the terms “first”, “second”, and “third”, and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A weighted yoga block with handle, the weighted yoga block with handle comprising:

a base member;

a first handle support member extending from the base member;

a second handle support member extending from the base member;

a handle connected to and rotatable with respect to the first and second handle support members; and the base member having an outer surface generally covered in a cushioned material;

wherein the base member has a generally wedge shape;

wherein the base member comprises:

a front side;

a rear side on a side opposite of the front side, and parallel to the front side;

a top side located generally between the first handle support member and the second handle support member, and generally parallel to the ground when the weighted yoga block with handle is orientated so that the handle is at the top of the weighted yoga block with handle;

a first angled side located between and abutting the front side and the rear side; the first angled side making an obtuse angle with and abutting the top side;

a second angled side located between and abutting the front side and the rear side; the second angled side making an obtuse angle with and abutting the first angled side;

a bottom side located between and abutting the front side and the rear side; the bottom side making an obtuse angle with and abutting the second angled side;

a third angled side located between and abutting the front side and the rear side; the third angled side making an obtuse angle with and abutting the bottom side; and a fourth angled side located between and abutting the front side and the rear side, the fourth angled side making an obtuse angle with and abutting the third angled side, the fourth angled side also making and obtuse angle with and abutting the top side.

2. The weighted yoga block with handle of claim 1, wherein all the abutting intersections are smoothed out so that the base member has no sharp edges.

3. The weighted yoga block with handle of claim 1, wherein the weighted yoga block with handle weighs in the range of between about 2 pounds and 10 pounds.

4. The weighted yoga block with handle of claim 1, further comprising a compartment in the base member configured to hold interchangeable weights in ranges of between about 2 pounds and 10 pounds.

5. The weighted yoga block with handle of claim 1, wherein the base member comprises:

an upper portion;

a lower portion removably attachable to the upper portion; and wherein the lower portion may be replaced with a different lower portion and wherein the different lower portion may weigh between about 2 and about 10 pounds.

6. The weighted yoga block with handle of claim 5, wherein the lower portion attaches to the upper portion via a dove tail configuration.

7. The weighted yoga block with handle of claim 5, wherein the lower portion comprises a dove tail pin, and the upper portion comprises a dove tail socket and dove tail pins configured to removeably attach to the dove tail pin.

8. The weighted yoga block with handle of claim 1, further comprising:

a first weight attached to the front side of the yoga block; and a second weight attached to the rear side.

9. The weighted yoga block with handle of claim 8, wherein the first and second weights are permanently attached.

10. The weighted yoga block with handle of claim 8, wherein the first and second weights are removeably attached.

11. The weighted yoga block with handle of claim 10, wherein the first and second weights can be replaced on the weighted yoga block with handle with weights of different weight.

* * * * *